US007186142B2

(12) United States Patent
Nagata et al.

(10) Patent No.: US 7,186,142 B2
(45) Date of Patent: Mar. 6, 2007

(54) COAXIAL CABLE CONNECTOR

(75) Inventors: Takayuki Nagata, Osaka (JP); Yasuo Nakai, Nara (JP)

(73) Assignee: Hosiden Corporation, Yao (JP)

( * ) Notice: Subject to any disclaimer, the term of this patent is extended or adjusted under 35 U.S.C. 154(b) by 0 days.

(21) Appl. No.: 11/108,701

(22) Filed: Apr. 19, 2005

(65) Prior Publication Data

US 2005/0239328 A1 Oct. 27, 2005

(30) Foreign Application Priority Data

Apr. 21, 2004 (JP) ..... 2004-125118

(51) Int. Cl.
*H01R 9/05* (2006.01)

(52) U.S. Cl. ..... 439/582; 439/585

(58) Field of Classification Search ..... 439/582, 439/581, 578–580, 583–585
See application file for complete search history.

(56) References Cited

U.S. PATENT DOCUMENTS 5,662,480 A 9/1997 Togashi
5,772,470 A * 6/1998 Togashi ..... 439/582
6,305,980 B2 * 10/2001 Ko ..... 439/582
6,712,645 B1 * 3/2004 Chou ..... 439/582
6,971,913 B1 * 12/2005 Chu ..... 439/582

FOREIGN PATENT DOCUMENTS

JP 2002-331997 11/2003

* cited by examiner

*Primary Examiner*—X. Chung-Trans
(74) *Attorney, Agent, or Firm*—Bacon & Thomas, PLLC

(57) ABSTRACT

A coaxial cable connector including a contact connected to a central conductor of a coaxial cable, an insulation body internally equipped with the contact, and a cylindrical receptacle fitting portion including a plurality of arc-shaped elastic springs which are arranged outside the insulation body on a concentric circle and connected to an outer conductor of the coaxial cable. In order to overcome the problem of degradation of the fitting retaining force of the receptacle fitting portion due to repeated fitting to a receptacle, there are provided elastic springs placed outside the receptacle fitting portion for making the receptacle fitting portion to partially have the configuration of double springs. Especially, the configuration of the double springs is formed by adjacent two arc-shaped elastic springs sandwiching the coaxial cable drawn out outwardly in the radial direction from the receptacle fitting portion.

10 Claims, 7 Drawing Sheets

COAXIAL CABLE CONNECTOR

BACKGROUND OF THE INVENTION

1. Field of the Invention

The present invention relates to a coaxial cable connector for use in a compact electronic apparatus such as a communication apparatus such as a portable phone or an electric measurement apparatus, among coaxial cable connectors for use in connections between substrates of various types of electronic apparatuses and coaxial cables and, more particularly, to a coaxial cable connector plug which is mounted to an end portion of a coaxial cable and is fitted to a coaxial cable connector receptacle mounted on a substrate.

2. Description of the Prior Art

To cope with the trend toward thinner, lighter and higher-density compact electronic apparatuses, there have been small-height and small size coaxial cable connectors (plugs) having reduced receptacle-fitting heights and reduced receptacle-mounted areas. Such connectors are known as L-shaped coaxial cable connecters which are fitted to an receptacle in the direction orthogonal to the drawing direction of a coaxial cable (refer to, for example, JP-A No. 2003-331997), and such an L-shaped coaxial cable connector is constituted by a contact which is connected to a central conductor of a coaxial cable, a substantially-cylindrical insulation body internally equipped with the contact at the center portion, and an outer conductor shell which includes a substantially-cylindrical receptacle fitting portion (4) housing the insulation body and drawing out the coaxial cable outwardly in the radial direction, the outer conductor shell being connected to an outer conductor of the coaxial cable. By fitting the receptacle fitting portion to the outside of a cylindrical outer conductor of a receptacle, the central conductor and the outer conductor of the coaxial cable are brought into conduction with the contact and the outer conductor of the receptacle through the contact and the outer conductor shell of the connector.

The receptacle fitting portion is formed from arc-shaped elastic springs arranged on a concentric circle outside the insulation body and the respective elastic springs are provided at their tip end portions with contact portions extending more inwardly than the outer diameter of the outer conductor of the receptacle. When the connector is fitted to the receptacle, the respective elastic springs press the contact portions against the outer peripheral surface of the outer conductor of the receptacle, thereby retaining the fitting between the plug and the receptacle and, therefore, the electric conduction therebetween.

The outer conductor shell includes a receptacle fitting portion, a lid portion which is extended from the opposite side of the receptacle fitting portion from the cable drawing-out portion thereof and is folded onto the bottom surface of the receptacle fitting portion, a crimp flange portion which is extended from the receptacle fitting portion via the lid portion in the cable drawing-out direction and is crimped to the coaxial cable, and a pair of right and left cable guides which are extended directly from the receptacle fitting portion in the cable drawing-out direction and is crimped to the inner side of the crimp flange portion while being in contact with an outer conductor of the coaxial cable, wherein the receptacle fitting portion internally equipped with the contact through the insulating body at the center position is crimped and secured to the end portion of the coaxial cable such that the cable drawing-out direction is perpendicular to the direction of insertion into and pull from a receptacle.

Before assembly, the outer conductor shell is formed in a half-developed state in which the continuous lid portion and crimp flange portion are extended upwardly from the bottom edge of the peripheral wall of the receptacle fitting portion while the cable guides are extended laterally from the opposite side of the receptacle fitting portion from the connecting portion connected with the lid portion (bend portion), with an attitude in which the receptacle-insertion port of the receptacle fitting portion is directed downwardly. Then, the insulation body is inserted into the receptacle fitting portion, at the half-developed state, from the bottom side. The continuous lid portion and crimp flange portion are folded to cover and close the bottom surface of the insulation body at a state where the contact solder-secured to the central conductor of the coaxial cable has been housed within the insulation body from the bottom surface. Thus, the crimp flange portion and the cable guides are extended from the receptacle fitting portion in the cable drawing-out direction. Subsequently, at the state where the cable guides are in contact with the outer conductor of the coaxial cable, the crimp flange portion is crimped from outside to complete the assembly of the connector.

SUMMARY OF THE INVENTION

Small-height and small-size L-shaped coaxial cable connectors induce no problem when they are pulled out from the receptacle at a normal condition where the receptacle fitting portion is held. However, due to the small heights and small sizes, they are pulled out by pulling the coaxial cable in many cases. In such cases, though the connector is easily disengaged through the principle of leverage as a bottle opener, stresses are concentrated to portions having poor construction strength in the receptacle fitting portion at this time, resulting in plastic deformation of the receptacle fitting portion or looseness in the crimped portion. If such insertion and pull are repeated, this may significantly degrade the fitting retaining force of the connector to cause accidental disengagement or vibrations, resulting in instantaneous interruption. Furthermore, with decreasing height and size, the designing of springs in the receptacle fitting portion becomes more difficult making it more difficult to ensure required initial retaining force, which induces the problem of degradation of the fitting retaining force of the connector.

Therefore, it is a main object of the present invention to prevent the receptacle fitting portion of a coaxial cable connector and, particularly a small-height and small-size coaxial cable connector, from degrading its fitting retaining force due to repeated fitting to a receptacle, resulting in occurrences of inconvenience such as accidental disengagement.

In order to attain the aforementioned object, the present invention provides a coaxial cable connector including a contact which is connected to a central conductor of a coaxial cable, an insulation body internally equipped with said contact, and a cylindrical receptacle fitting portion including a plurality of arc-shaped elastic springs which are arranged outside said insulation body on a concentric circle and connected to an outer conductor of said coaxial cable, wherein there are provided elastic springs placed outside the receptacle fitting portion for making the receptacle fitting portion to partially have the configuration of double springs.

Preferably, the configuration of the double springs is formed by adjacent arc-shaped elastic springs sandwiching the coaxial cable drawn out outwardly in the radial direction from the receptacle fitting portion.

Preferably, the outer elastic springs of the double springs have been bent into an arc shape or a tangential straight shape such that the movable tip end portions thereof are more inward than the outer diameter of the receptacle fitting portion, before being placed outside the receptacle fitting portion.

Preferably, the outer elastic springs of the double springs are formed, by bending, from a portion of an outer conductor shell placed outside the receptacle fitting portion.

In the case of a coaxial cable connector including a contact which is connected to a central conductor of a coaxial cable, an insulation body internally equipped with said contact, and a cylindrical receptacle fitting portion including a plurality of arc-shaped elastic springs which are arranged outside said insulation body on a concentric circle and are connected to an outer conductor of said coaxial cable, when the connector is pulled out from the receptacle by pulling the coaxial cable, a largest stress is exerted on the cable drawing-out portion of the receptacle fitting portion (the A and B portions in FIG. 1), which forces the portions outwardly (the directions of the arrows a and b in FIG. 1) to expand them. However, in the present invention, since the receptacle fitting portion partially has the configurations of the double springs, it has an increased elastic force which disperses stresses therein to alleviate displacement and deformation of the same portions. Since the receptacle fitting portion has an increased elastic force and thus is less prone to deformation, it is possible to effectively prevent degradation of the fitting retaining force due to repeated insertion and pull and also it is possible to increase the initial retaining force, which improves the reliability of the fitting and contact. This can prevent the receptacle fitting portion from degrading its fitting retaining force resulting in inconvenience of accidental disengagement, etc., due to repeated fitting of a coaxial cable connector, particularly a small-height and small size L-shaped coaxial cable connector, into a receptacle.

The receptacle fitting portion has a lowest strength at the cable drawing-out portion (the A and B portions in FIG. 1). Therefore, by forming the adjacent arc-shaped elastic springs sandwiching the coaxial cable drawn out outwardly in the radial direction from the receptacle fitting portion to have the double-spring configuration, the lowest-strength portion of the receptacle fitting portion can be reinforced, thereby effectively alleviating degradation in the fitting retaining force due to repeated insertion and pull.

The outer elastic springs of the double springs are bent into an arc shape or a tangential straight shape such that their movable tip end portions are more inward than the outer diameter of the receptacle fitting portion, before being placed outside the receptacle fitting portion. Consequently, when the outer elastic springs of the double springs are placed outside the receptacle fitting portion, an initial displacement is generated, thus exerting a load to the double springs. Since the receptacle fitting portion has already had an increased elastic force before the coaxial cable is pulled at the state where the connector is fitted to the receptacle, it has greater resistance against deformation and exhibits reduced characteristic changes against repeated insertion and pull, in comparison with configurations which constitute double springs halfway through the displacement. Consequently, it is possible to effectively alleviate degradation of the fitting retaining force due to repeated insertion and pull. Also, the bending of the outer elastic springs of the double springs can be performed after they are placed outside the receptacle fitting portion, and in such a case, their movable tip end portions are bent into an arc shape or a tangential straight shape such that they are brought into contact with the outer peripheral surface of the receptacle fitting portion. In the case of bending the outer elastic springs of the double springs after placing them outside the receptacle fitting portion, the assembly of the connector will be easier.

Further, since the outer elastic springs of the double springs are formed, by bending, from portions of the outer conductor shell placed outside the receptacle fitting portion, the outer elastic springs are integral with the outer conductor shell, which can alleviate reduction of the fitting retaining force due to repeated insertion and pull without increasing the number of components and the number of assembly processes. In addition to forming the outer elastic springs of the double springs integrally with the outer conductor shell, they can also be constituted by U-shaped springs made from metal sheets or made by wire-forming or can be also constituted by resin springs formed concentrically with the body cylindrical shape by forming integrally with the insulation body.

DESCRIPTION OF THE PREFERRED EMBODIMENT

Figure 1:
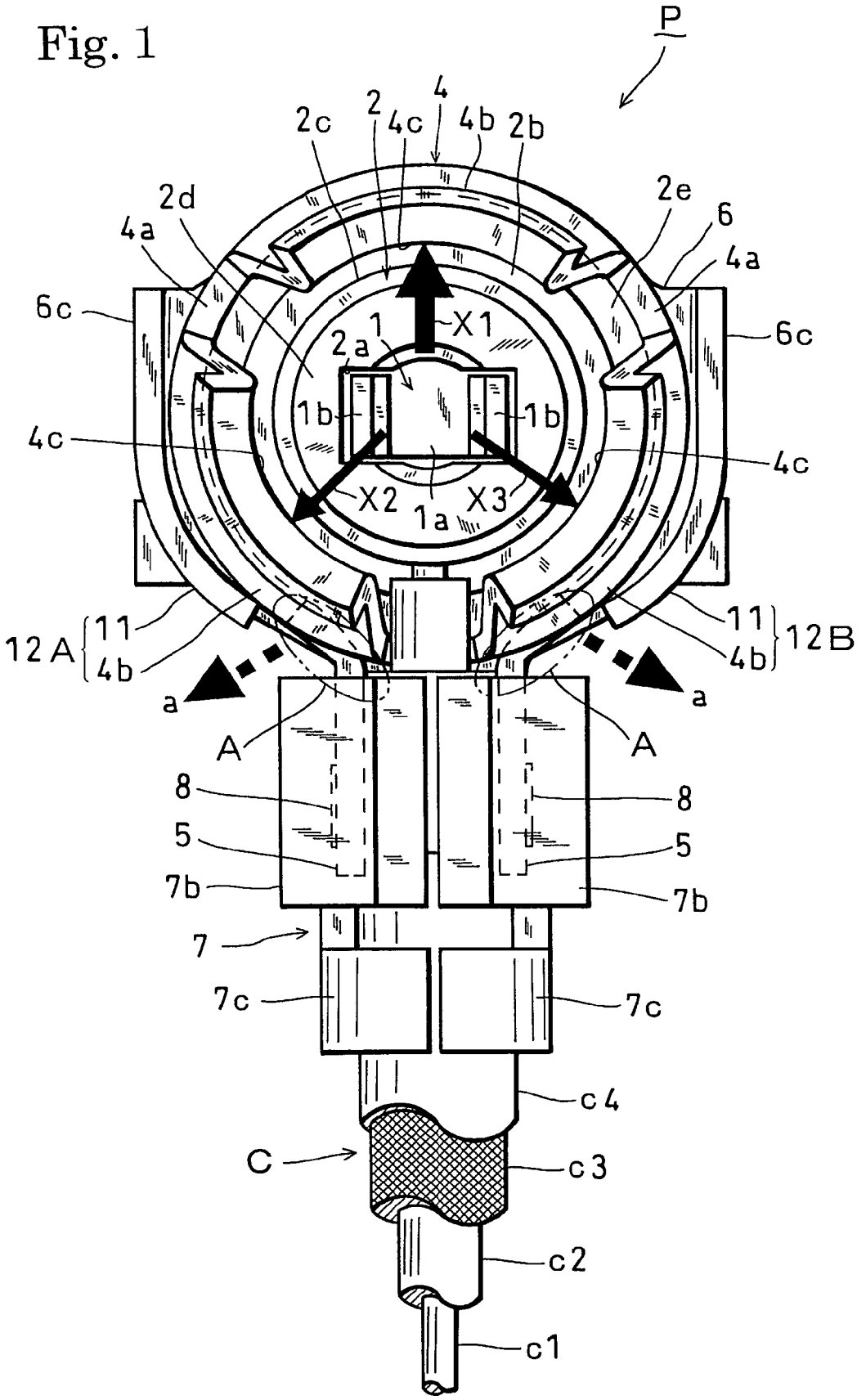
FIG. 1 is a plan view of a coaxial cable connector illustrating an embodiment of the present invention.

Hereinafter, embodiments of the present invention will be described, on the basis of the drawings. In the figures, S designates a connecter receptacle for a coaxial cable and P designates a connector (plug) for a coaxial cable. The receptacle S is constituted by a resin insulation body 100 having a rectangular-plate shape, a shaft-type metal (conductive) contact 110 vertically extending from substantially the center potion of the upper surface of the insulation body 100, and a cylindrical metal (conductive) outer conductor 130 extending vertically from the upper surface of the insulation body 100 around the contact 110 with an annular space 120 interposed therebetween, wherein the insulation body 100 is concentric with the contact 110. Further, the receptacle S includes, at the base end portion of the contact 110, a substrate contact portion 110*a* having an lower surface exposed flash with the bottom surface of the insulation body 100 and a tip end portion protruded from the center portion of one side edge of the insulation body 100. Further, the receptacle S includes, at the base end portion of the outer conductor 130, a pair of substrate contact portions 130*a*, 130*a* having lower surfaces exposed flash with the bottom surface of the insulation body 100 and tip end portions protruded from the center portions of the two opposed side edges of the insulation body 100 which are adjacent to the side edge of the insulation body 100 from which the contact portion 110*a* of the contact 110 is protruded. For example, the respective substrate contact portions 110*a*, 130*a*, 130*a* are secured on a substrate (not shown) of a compact electronic apparatus such as a portable phone by means of soldering so that the receptacle S is mounted on the surface while being electrically connected thereto and there is provided, on the substrate, an opening for inserting the connecter P thereinto.

In the figures, C designates a coaxial cable which includes a central conductor c1, an inner insulation cover layer c2 around the outer periphery of the central conductor c1, a hollow cylindrical conductor or an outer conductor c3 around the outer periphery of the inner insulation cover layer c2, and an outside jacket c4 covering the outer periphery of the outer conductor c3, which is the outside insulation cover layer at the cable surface. The end portion of the coaxial cable C which is to be attached to the connector P which will be described later has been subjected to a peeling process for exposing the central conductor c1 by a predetermined length and subsequently exposing the outer conductor c3 by a predetermined length.

The connector (plug) P is constituted by a metal (conductive) contact 1 made of a cupper alloy, etc., which is solder connected to the central conductor c1 of the coaxial cable C, a resin insulation body 2 having substantially a cylindrical shape with a step portion which houses and surrounds the contact 1 at the center portion thereof and draws out the coaxial cable C in the radial direction from the outer peripheral surface, and an outer conductor shall 3 made from a thin sheet metal (conductive) made of a cupper alloy, etc.

The contact 1 includes a connecting portion 1*a* which is solder connected at its tip end to the central conductor c1 of the coaxial cable C, and a pair of contact portions 1*b*, 1*b* constituted by flat springs extended oppositely from the both side edges of the connecting portion 1*a* for interposing the contact 110 of the receptacle S therebetween to bring it into contact therewith.

The insulation body 2 includes a substantially L-shaped hollow portion 2*a* to house the contact 1. The vertical hollow portion 2*a* formed along the axis at the center portion of the insulation body 2 has an end portion which is opened at the center portion of the tip end surface 2*d* of the small-diameter portion 2*c* closer to the tip end portion than the step portion 2*b* of the insulation body 2. By inserting the contact 110 of the receptacle S into the vertical hollow portion 2*a* from the center portion of the tip end surface 2*d* of the small-diameter portion 2*a*, it is brought into contact with the pair of contact portions 1*b*, 1*b* of the contact 1 placed at the opposite sides of the vertical hollow portion 2*a*. The lateral hollow portion 2*a* formed through the insulation body 2 in the radial direction from the center portion thereof has an end portion opened at the outer peripheral surface of the large-diameter portion 2*e* closer to the basal end than the step portion 2*b* of the insulation body 2. By solder connecting, the central conductor c1 of the coaxial cable C to the tip end portion of the connecting portion 1*a* of the contact 1 placed within the lateral hollow portion 2*a*, the coaxial cable C is drawn out in the radial direction through the outer peripheral surface of the insulation body 2.

The outer conductor shell 3 is formed by die-cutting a flat plate into a predetermined shape and then bending it and includes a substantially-cylindrical receptacle fitting portion 4, a pair of right and left cable guides 5, 5, a lid portion 6 and a crimp flange portion 7. The receptacle fitting portion 4 and the cable guides 5, 5 are configured in the following manner. Band-shaped sheets are curved into substantially a semicircular shape and their basal portions at one sides with respect to their center portions and their basal portions at the other sides are opposed to one another. The remaining end portions are straightly elongated in a single direction (radial direction) from the end portions of the curved portion such that they are opposed to each other with a predetermined interval provided therebetween. Thus, the opposed substantially-semicircular curved portions constitute the partially-interrupted C-shaped cylindrical wall of the receptacle fitting portion 4 and the opposed straight portions (parallel portions) constitute the pair of right and left cable guides 5, 5. The insulation body 2 is housed at a concentric position within the receptacle fitting portion 4 and the coaxial cable C drawn out in the radial direction through the outer peripheral surface of the insulation body 2 is drawn out in the radial direction through the interrupted portion of the cylindrical wall of the receptacle fitting portion 4 and between the right and left cable guides 5, 5. The portion of the coaxial cable C from which the outside jacket c4 has been striped is held between the right and left cable guides 5, 5 and thus the cable guides 5, 5 are brought into contact with the outer conductor c3.

The lid portion 6 is formed to be a polygonal shape which covers and closes the bottom opening of the receptacle fitting portion 4 at the opposite side thereof from the receptacle insertion port and includes, at its one side, a narrow-width connecting portion 6*a* connected to the crimp flange portion 7. The crimp flange portion 7 includes a flat base portion 7*a* continuous with the lid portion 6 via the connecting portion 6*a*, a pair of right and left basal crimping pieces 7*b*, 7*b* which are inclinedly extended from both the basal-end-side side edges of the basal portion 7*a* such that the relative distance therebetween is gradually increased as advancing toward the tip end portion, and a pair of right and left end crimping pieces 7*c*, 7*c* which are inclinedly extended from the both tip-end-side side edges of the base portion 7*a* such that the relative distance therebetween is gradually increased as advancing toward the tip end. The crimp flange portion 7 is formed to be continuous with one side of the lid portion 6. The lid portion 6 includes a to-be-bent portion 6*b* having a narrow width which is a connecting portion connected to the receptacle fitting portion 4 and which will be bent later, at the opposite side of the lid portion 6 from the crimp flange portion 7. The continuous lid portion 6 and crimp flange portion 7 are foldably formed at the cylindrical-wall bottom edge at the opposite side from the interrupted portion of the cylindrical wall of the receptacle fitting portion 4 (the opposite side from the cable drawing-out portion), through the to-be-bent portion 6*b*. The continuous lid portion 6 and crimp flange portion 7 are folded from the half-developed state before assembly in which the to-be-bent portion 6*b* is straightened and the lid portion 6 and crimp flange portion 7 are vertical with respect to the bottom surfaces of the receptacle fitting portion 4 and the right and left cable guides 5, 5 as illustrated by a two-dot chain line in FIG. 7 into the assembled state in which the to-be-bent portion 6*b* is bent and the lid portion 6 and crimp flange portion 7 are along the bottom surfaces of the receptacle fitting portion 4 and the right and left cable guide portions 5, 5 as illustrated by a solid line in FIG. 7. As a result of the folding, the lid portion 6 extends over the bottom opening of the receptacle fitting portion 4 to cover and close the bottom opening, and the crimp flange portion 7 extends via the lid portion 6 from the receptacle fitting portion 4 in the cable drawing-out direction. The base portion 7*a* and the basal crimping pieces 7*b*, 7*b* at the basal portion of the crimp flange portion 7 enclose the right and left cable guides 5, 5, which pass the coaxial cable C therebetween and are brought into contact with the outer conductor c3, and they are crimped to the coaxial cable C.

The base portion 7*a* and the right and left end crimping pieces 7*c*, 7*c* at the end portion of the crimp flange portion 7 enclose the unpeeled portion of the coaxial cable C drawn out through the right and left cable guides 5, 5, and then they are crimped to the coaxial cable C.

As described above, the outer conductor shell 3 includes, at one side with respect to the to-be-bent portion 6*b*, the receptacle fitting portion 4 in the basal portion and the pair of right and left cable guides 5, 5 in the end portion. Further, the outer conductor shell 3 includes, at the other side with respect to the to-be-bent portion 6*b*, the lid portion 6 in the basal portion and the crimp flange portion 7 in the end portion. Further, the outer conducting shell 3 includes, at the side with respect to the to-be-bent portion 6*b* which is provided with the cramp flange portion 7, through holes (confirmation windows) 8, 8 for checking the state of the other side of the outer conductor shell 3 with respect to the to-be-bent portion 6*b* which is provided with the receptacle fitting portion 4. The outer conducting shell 3 includes protrusions 9, 9 at the side thereof with respect to the to-be-bent portion 6*b* which is provided with the receptacle fitting portion 4. The through holes 8, 8 are provided at the positions into which the protrusions 9, 9 are fitted when the outer conductor shell 3 is bent at the to-be-bent portion 6*b* into the crimping state. More specifically, the protrusions 9, 9 are formed to be protruded from the bottom surfaces of the tip ends of the right and left cable guides 5, 5 which are to be joined to the base portion 7*a* of the crimp flange portion 7 and the length of the protruded portions is substantially equal to the thickness of the base portion 7*a* (the depth of the through holes 8) of the crimp flange portion 7. In correspondence with the protrusions 9, 9, the through holes 8, 8 are laterally juxtaposed in the base portion 7*a* of the crimp flange portion 7.

The receptacle fitting portion 4 of the outer conductor shell 3 includes a plurality (three in the present embodiment) of slits 4*a*, 4*a* extending to a predetermined depth from the receptacle-inserting-port side edge for substantially equally dividing the tip end portion which is to be faced to the small-diameter portion 2*c* of the insulation body 2 housed therewith, into plural portions (three portions, in the present embodiment). The three portions of the cylindrical wall which are separated substantially equally by the two slits 4*a*, 4*a* are formed as arc-shaped elastic springs 4*b*, 4*b*, 4*b* which are elastically displacable in the radial directions. Each of the three arc-shaped elastic springs 4*b*, 4*b*, 4*b* is provided, at its tip end portion, with a contact portion 4*c* protruded more inwardly than the outer diameter of the outer conductor 130 of the receptacle S and the three arc-shaped elastic springs 4*b*, 4*b*, 4*b* are arranged on a concentric circle outside the small-diameter portion 2*c* of the insulation body 2.

The insulation body 2 is configured in the following manner. The large-diameter portion 2*e* closer to the base end than the step portion 2*b* has an outer diameter which is greater than the outer diameter of the outer conductor 130 of the receptacle S and is substantially equal to the inner diameter of the bottom side of the receptacle fitting portion 4 which is not split. The small-diameter portion 2*c* closer to the tip end side than the step portion 2*b* has an outer diameter which is smaller than the inner diameter of the contact portions 4*c* of the respective arc-shaped elastic springs 4*b*, 4*b*, 4*b* of the receptacle fitting portion 4 placed outside the small-diameter portion 2*c* by a predetermined dimension and is smaller than the inner diameter of the outer conductor 130 of the receptacle S. The insulation body 2 is housed and supported at a concentric position within the receptacle fitting portion 4 by means of the outer diameter of the large-diameter portion 2*e*. Thus, there is provided an annular space 10 for fitting the outer conductor 130 of the receptacle S thereinto, between the small-diameter portion 2*c* of the insulation body 2 and the elastic springs 4*b*, 4*b*, 4*b* of the receptacle fitting portion 4 placed on a concentric circle outside the smaller-diameter portion 2*c*.

The height of the insulation body 2 is set such that the tip end face 2*d* of the small-diameter portion 2*c* of the insulation body 2 for inserting the center contact 110 of the receptacle S thereinto is protruded in the insertion direction by a predetermined dimension from the tip end portions of the respective arc-shaped elastic springs 4*b*, 4*b*, 4*b*, when the insulation body 2 is housed with in the receptacle fitting portion 4 with the bottom surface thereof in contact with the lid portion 6.

The connector P includes elastic springs 11 placed outside the receptacle fitting portion 4 of the outer conductor shell 3 to make the receptacle fitting portion 4 partially have the configuration of double springs 12A, 12B.

The outer elastic springs 11 of the double springs 12A, 12B are constituted by cantilever flat springs 11*a*, 11*a* extended integrally from a pair of positioning walls 6*c*, 6*c* which are extended from and folded with respect to the right and left side edges of the lid portion 6 and are opposed to each other across the receptacle fitting portion 4 in the direction orthogonal to the cable drawing-out direction toward the cable drawing-out direction. The flat springs 11*a*, 11*a* are bent into an arc shape or a tangential straight shape such that the flat springs 11*a*, 11*a* gradually get closer to the receptacle fitting portion 4 with decreasing distance to their tip end portions and the movable tip end portions of the flat springs 11*a*, 11*a* are brought into contact with the outer peripheral surface of the receptacle fitting portion 4 at portions near the extended portions of the right and left cable guides 5, 5 to form the outer springs 11 of the double springs 12A, 12B. The two adjacent arc-shaped elastic springs 4*b*, 4*b* sandwiching the coaxial cable C outwardly drawn out in the radial direction from the receptacle fitting portion 4 constitute the double springs 12A, 12B in cooperation with the two elastic springs 11, 11 placed outside thereof. The outer elastic springs 11, 11 of the double springs 12A, 12B are formed to have a height smaller than that of the inner elastic springs, namely the arc-shaped elastic springs 4*b*, 4*b* of the receptacle fitting portion 4.

Figure 6:
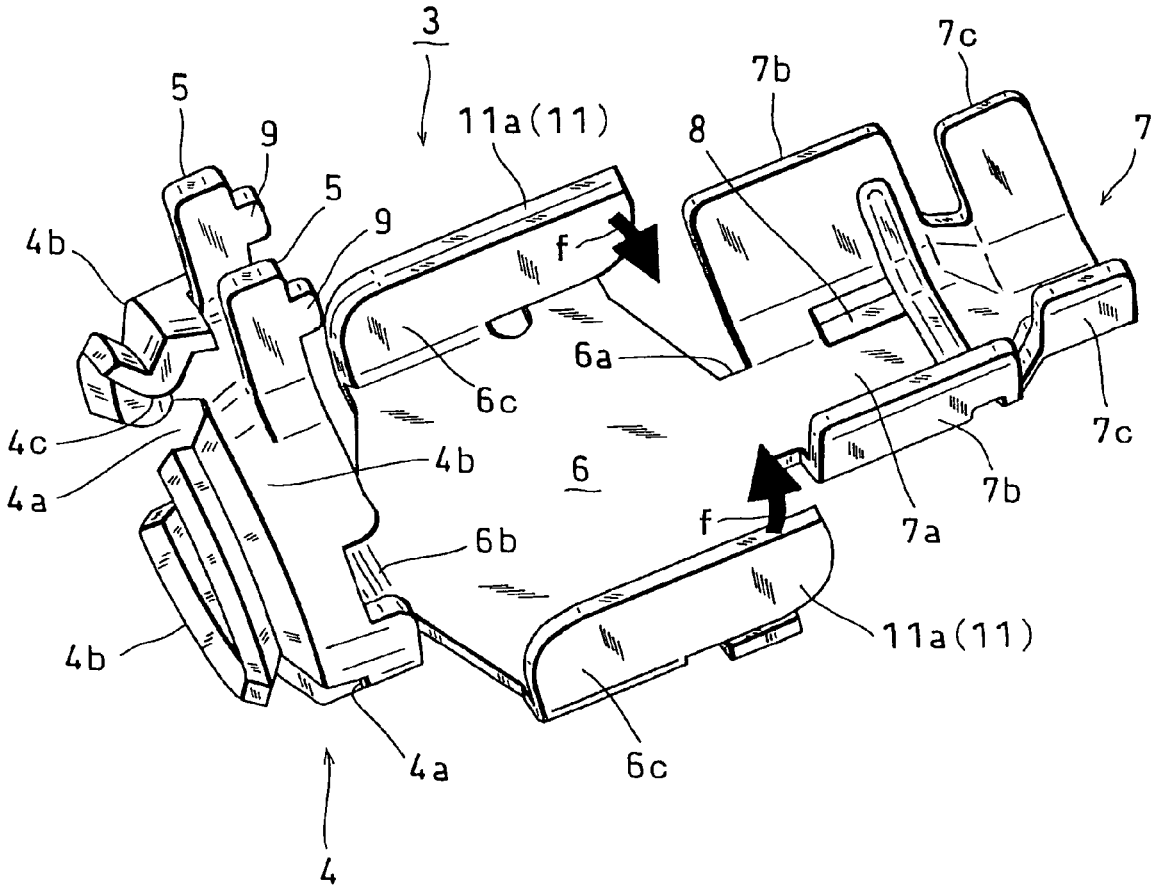
FIG. 6 is an external perspective view of an outer conductor shell.

The flat springs 11*a*, 11*a* formed, by bending, as the outer elastic springs 11, 11 of the double springs 12A, 12B are configured in the following manner. At a half-developed state before assembly in which the to-be-bend portion 6*b* of the outer conductor shell 3 is straightened so that the lid portion 6 and the crimp flange portion 7 are perpendicular to the bottom surfaces of the receptacle fitting portion 4 and the right and left cable guides 5, 5 as illustrated by two-dot chain lines in FIG. 6 and FIG. 7, before the flat springs 11*a*, 11*a* are placed outside the receptacle fitting portion 4, the flat springs 11*a*, 11*a* are bent in the direction of an arrow f into an arc shape or a tangential straight shape such that their movable tip end portions are more inward than the outer diameter of the receptacle fitting portion 4. Further, as shown by solid line in FIG. 7, when the outer conductor shall 3 is bent at the to-be-bent portion 6*b* so that the lid portion 6 and the crimp flange portion 7 are along the bottom surfaces of the receptacle fitting portion 4 and the right and left cable guides 5, 5, the outer elastic springs 11, 11 of the double springs 12A, 12B are placed outside the receptacle fitting portion 4, causing an initial displacement which exerts a load to the double springs 12A, 12B.

Next, assembling of the connector P will be described. First, the outer conductor shell 3 at the half-developed state is placed with an attitude in which the receptacle insertion port of the receptacle fitting portion 4 is oriented downwardly. The insulation body 2 is inserted into the receptacle fitting portion 4 from the bottom side, and the contact 1 solder connected to the central conductor c1 of the coaxial cable C is housed in the hollow portion 2*a* of the insulation body 2. The coaxial cable C drawn out in the radial direction through the outer peripheral surface of the insulation body 2 is drawn out through the interrupted portion of the cylindrical wall of the receptacle fitting portion 4 and between the right and left cable guides 5, 5 outwardly in the radial direction of the receptacle fitting portion 4, and the portion of the coaxial cable C from which the outer jacket c4 has been stripped is clamped by the right and left cable guides 5, 5 so that the right and left cable guides 5, 5 are brought into contact with the outer conductor c3.

Figure 7:
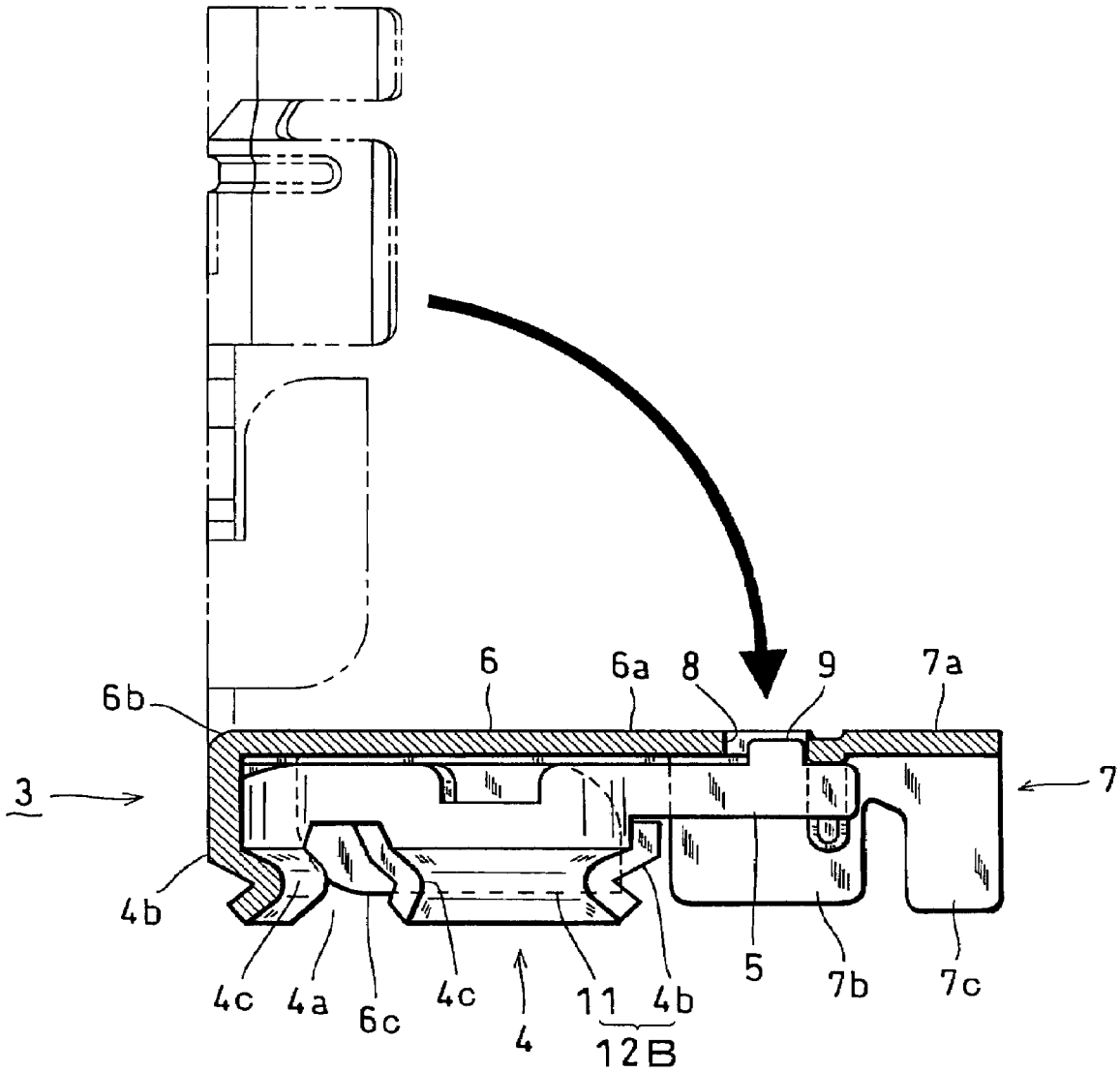
FIG. 7 is across sectional side view of the outer conductor shell.

Then, the continuous lid portion 6 and crimp flange portion 7 are folded at the to-be-bent portion 6*b* from the vertical attitude indicated by the two-dot chain line in FIG. 7 into the horizontal attitude indicated by the solid line so that the bottom opening of the receptacle fitting portion 4 is covered and closed by the lid portion 6, the base portion 7*a* and the right and left basal crimping pieces 7*b*, 7*b* at the basal portion of the crimp flange portion 7 surround the right and left cable guides 5, 5 which pass the coaxial cable C therebetween and are in contact with the outer conductor c3, and the base portion 7*a* and the right and left end crimping pieces 7*c*, 7*c* at the end portion of the crimp flange portion 7 surround the unpeeled portion of the coaxial cable C drawn out through between the right and left cable guides 5, 5.

Further, as a result of the folding of the outer conductor shell 3 as described above, the left and right protrusions 9, 9 formed on the tip end portions of the right and left cable guides 5, 5 are fitted into the two through holes 8, 8 which are laterally juxtaposed in the basal portion of the base portion 7*a* of the crimp flange portion 7.

Further, the right and left positioning walls 6*c*, 6*c* extended from and folded with respect to the right and left side edges of the lid portion 6 are moved to the positions which are opposed to each other across the receptacle fitting portion 4, at right and left portions outside the receptacle fitting portion 4, in the direction orthogonal to the cable drawn-drawn direction. The right and left elastic springs 11, 11 which are extended integrally from the positioning walls 6*c*, 6*c* in the cable drawn-out direction and have been bent in advance into an arc shape or a tangential straight shape such that their movable tip end portions are more inward than the outer diameter of the receptacle fitting portion 4 are moved to the outside of the two adjacent arc-shaped elastic springs 4*b*, 4*b* sandwiching the coaxial cable C drawn out outwardly from the receptacle fitting portion 4 in the radial direction, and the two arc-shaped elastic springs 4*b*, 4*b* constitute the double spring 12A, 12B configuration in cooperation with the two elastic springs 11, 11 placed outside thereof. At this time, the movable tip end portions of the right and left elastic springs 11, 11 are pressed against the outer peripheral surface of the receptacle fitting portion 4 near the extended portions of the right and left cable guides 5, 5 to cause an initial displacement thereof, which exerts a load to the double springs 12A, 12B themselves, resulting in an increase of the elastic force of the receptacle fitting portion 4.

In the prior art, as a result of the folding of the outer conductor shell 3, the side of the outer conductor shell 3 with respect to the to-be-bent portion 6*b* which is provided with the lid portion 6 and the crimp flange portion 7 has been superimposed on the side of the outer conductor shell 3 with respect to the to-be-bent potion 6*b* which is provided with the receptacle fitting portion 4 housing the insulation body 2 and the right and left cable guides 5, 5 so that the upper side of the outer conductor shell 3 covers the lower side of the outer conductor shell 3, which has made impossible to confirm the state of the lower side of the outer conductor shell 3, namely the state of the receptacle fitting portion 4 (whether or not the receptacle fitting portion 4 is settled in the predetermined position, or whether or not there is an abnormality such as rising, decentering or deformation). However, by means of the through holes 8, 8 and also by means of the fitting between the through holes 8, 8 and the protrusions 9, 9, it is possible to confirm such states adequately, accurately and easily. Such confirmation can be performed by observing the fitting condition of the protrusions 9, 9 such as the positions and the depths of the protrusions 9, 9 fitted into the right and left through holes 8, 8 or by comparing the fitting conditions of the right and left protrusions 9, 9 and observing the difference therebetween.

In the case where it is determined from the aforementioned confirmation that the receptacle fitting portion 4 is not settled at the predetermined position and there is an abnormality such as rising, decentering or deformation, the connector may become a defective product incapable of being normally fitted to the receptacle S, and therefore an adequate action is applied thereto to eliminate the abnormality or the connector is dismounted. Then, by using a normal connector having no abnormality observed therein, a crimping process is conducted to crimp the basal portion and the end portion of the crimp flange portion 7 to the coaxial cable C for plastically deforming them to assemble the connector P into the assembled state illustrated in FIG. 1 to FIG. 5.

In the aforementioned crimping process, the fitting between the thorough holes 8, 8 and the protrusions 9, 9 exerts a function of positioning the side of the outer conductor shell 3 with respect to the to-be-bent portion 6*b* which is provided with the receptacle fitting portion 4 and the right and left cable guides 5, 5 relative to the side of the outer conductor shell 3 with respect to the to-be-bent portion 6*b* which is provided with the lid portion 6 and the crimp flange portion 7, which prevents, during the crimping, the receptacle fitting portion 4 from being displaced, decentered or deformed in the cable drawn-out direction or the direction opposite or orthogonal to the cable drawn-out direction.

Therefore, the assembled connector P includes the contact 1 connected to the central conductor c1 of the coaxial cable C, the substantially-cylindrical insulation body 2 internally equipped with the contact 1 at the center portion, and the outer conductor shell 3 made from a sheet metal and connected to the outer conductor c3 of the coaxial cable C. The outer conductor shell 3 includes a plurality of arc-shaped elastic springs 4*b*, 4*b*, 4*b* arranged on a concentric circle outside the insulation body with an annual space 10 interposed therebetween. The outer conductor shell 3 includes the receptacle fitting portion 4 having a substantially cylindrical shape for housing the insulating body 2 and for drawing out the coaxial cable C outwardly in the radial direction, the lid portion 6 extended from the opposite side of the receptacle fitting portion 4 from the cable drawing-out portion and folded onto the bottom surface of the receptacle fitting portion 4, the crimp flange portion 7 extended from the receptacle fitting portion 4 through the lid portion 6 in the cable drawing-out direction and crimped to the coaxial cable C, and the pair of right and left cable guides 5, 5 extended directly from the receptacle fitting portion 4 in the cable drawing-out direction and crimped to the inner side of the crimp flange portion 7 while being in contact with the outer conductor c3 of the coaxial cable C. Consequently, the connector P is an L-shaped coaxial cable connector in which the receptacle fitting portion 4 equipped with the contact 1 through the insulation body 2 at the center position is crimped and secured to the end portion of the coaxial cable C such that the cable drawing-out direction is perpendicular to the direction of insertion into and pulling from the receptacle S.

In addition to the aforementioned configurations, the side of the outer conductor shell 3 with respect to the to-be-bent portion 6*b* which is provided with the crimp flange portion 7 is provided with the through holes 8, 8 (confirmation windows) for checking the state of the outer side of the conductor shell 3 on the other side. Consequently, when the clamping (crimping) process is to be conducted, the through holes 8, 8 are utilized to check the state of the side of the outer conductor shell 3 provided with the receptacle fitting portion 4 with respect to the to-be-bent portion 6*b*, namely the state of the receptacle fitting portion 4. After confirming that there is no abnormality, the process is conducted, and therefore it is possible to substantially prevent occurrences of a detective product due to bending failures of the outer conductor shell 3, etc. Since there are provided the plurality of through holes 8, 8, the state of the receptacle fitting portion 4 can be adequately checked with high accuracy. Further, there are provided the protrusions 9, 9 on the side of the outer conductor shell 3 provided with the receptacle fitting portion 4 with respect to the to-be-bent portion 6*b* and the protrusions 9, 9 are fitted in the through holes 8, 8 when the outer conductor shell 3 is bent into the crimping state. Thus, the protrusions 9, 9 serve as an indicator, which enables checking the state of the receptacle fitting portion 4 more adequately, accurately and easily by observing the fitting condition of the protrusions 9, 9 such as the positions and the depths of the protrusions 9, 9 fitted into the through holes 8, 8. Further, at the state where the protrusions 9, 9 are fitted in the through holes 8, 8, namely at the state where the side of the outer conductor shell 3 provided with the receptacle fitting portion 4 with respect to the to-be-bent portion 6*b* is positioned relative to the other side of the outer conductor shell 3 provided with the crimp flange portion 7 with respect to the to-be-bent portion 6*b* by the protrusions 9, 9 and the thorough holes 8, 8, the crimp flange portion 7 is crimped to the coaxial cable C, and, during the crimping, the receptacle fitting portion 4 is prevented from being displaced, decentered or deformed in the cable drawing-out direction or the direction opposite or orthogonal to the cable-drawing-out direction. Furthermore, since the through holes 8, 8 are provided in the crimp flange portion 7 and the protrusions 9, 9 are provided on the cable guides 5, 5, it is possible to confirm the state of the receptacle fitting portion 4 at a position which is separated (remote) from the to-be-bent portion 6*b* of the outer conductor shell 3 and prominently exhibits the state of the receptacle fitting portion 4, which makes such confirmation more adequate, accurate and easy. Moreover, the protrusions 9, 9 are fitted into the through holes 8, 8 at a position separated from the to-be-bent portion 6*b* of the outer conductor shell 3, and the cable guides 5, 5 engaged with the crimp flange portion 7 by the fitting are crimped to the inner side of the crimp flange portion 7, thereby effectively suppressing displacement, decentering and deformation of the receptacle fitting portion 4. Furthermore, the protrusions 9, 9 are provided on the tip end portions of the pair of right and left cable guides 5, 5 and the two through holes 8, 8 are laterally juxtaposed in the crimp flange portion 7 in correspondence with the respective protrusions 9, 9, thus providing all the effects of the aforementioned configurations. Further, this enables checking the state of the receptacle fitting portion 4 more adequately, accurately and easily by comparing the fitting states of the right and left protrusions 9, 9 and observing the difference therebetween.

As described above, the receptacle fitting portion 4 of the outer conductor shell 3 is fitted to the receptacle S, wherein the receptacle fitting portion 4 has been prevented from being displaced, decentered or deformed during the assembly. The receptacle fitting portion 4 houses, at a concentric position, the substantially-cylindrical stepped insulation body 2 internally equipped with the contact 1 at the center portion and is placed outside the insulation body 2 with the annular space 10 interposed therebetween. The receptacle fitting portion 4 includes the slits 4*a*, 4*a* and there are the split cylindrical walls which are separated into plural portions by the slits 4*a*, 4*a* and elastically displacable in the radial direction, namely the plurality of arc-shaped elastic springs 4*b*, 4*b*, 4*b*, which are arranged on a concentric circle outside the insulation body 2 with the annular space 10 interposed therebetween. Further, the two adjacent arc-shaped elastic springs 4*b*, 4*b* sandwiching the coaxial cable C drawn out outwardly in the radial direction from the receptacle fitting portion 4 constitute the double spring configurations 12A, 12B in cooperation with the two elastic springs 11, 11 placed outside thereof. Further, the tip end surface 2*d* of the insulation body 2 is protruded by a predetermined dimension from the tip end portions of the respective arc-shaped elastic springs 4*b*, 4*b*, 4*b*, in the direction of insertion into the receptacle S.

Figure 2:
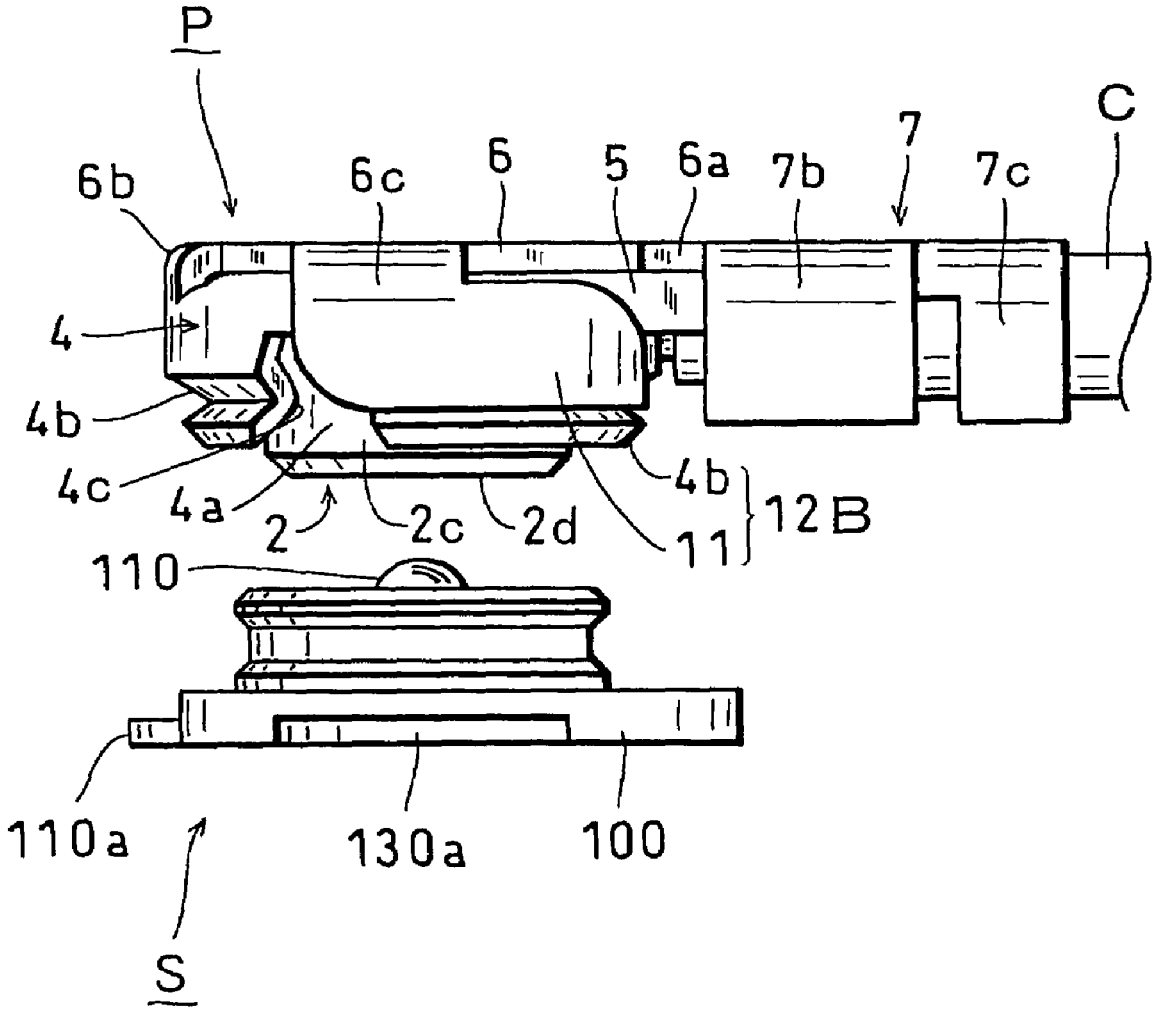
FIG. 2 is a side view of the connector at an unfitted state.
Figure 3:
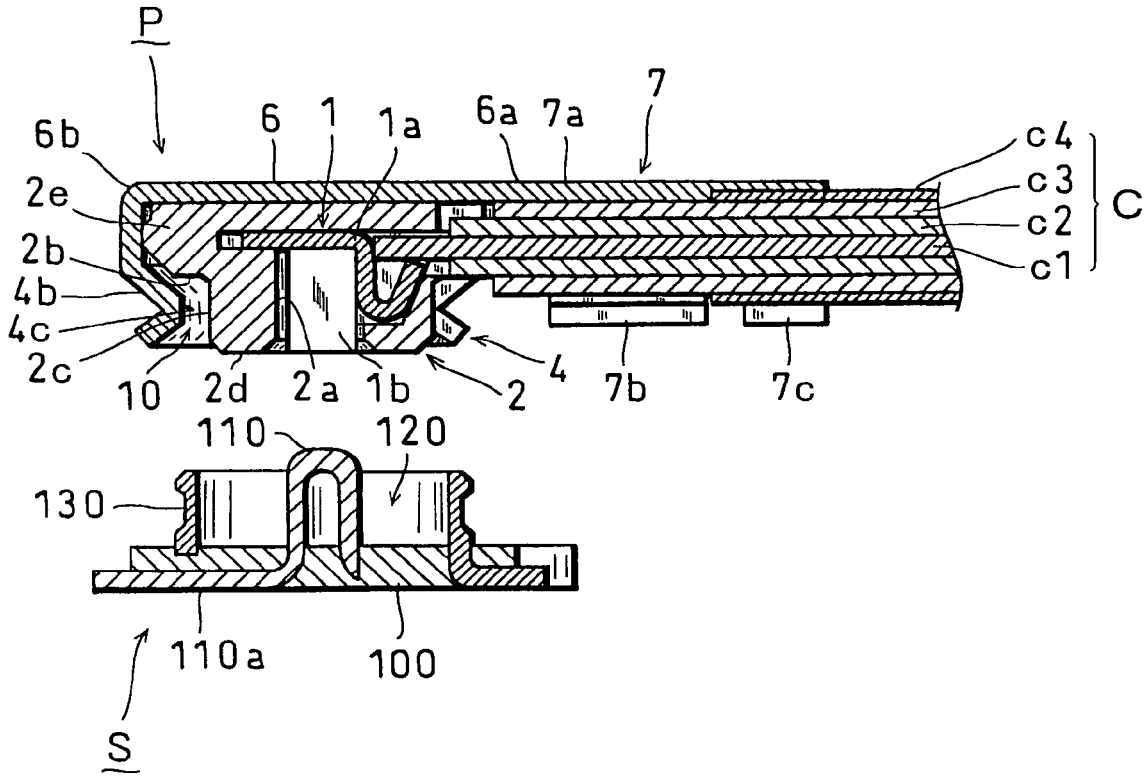
FIG. 3 is a cross sectional side view of the connector at an unfitted state.
Figure 4:
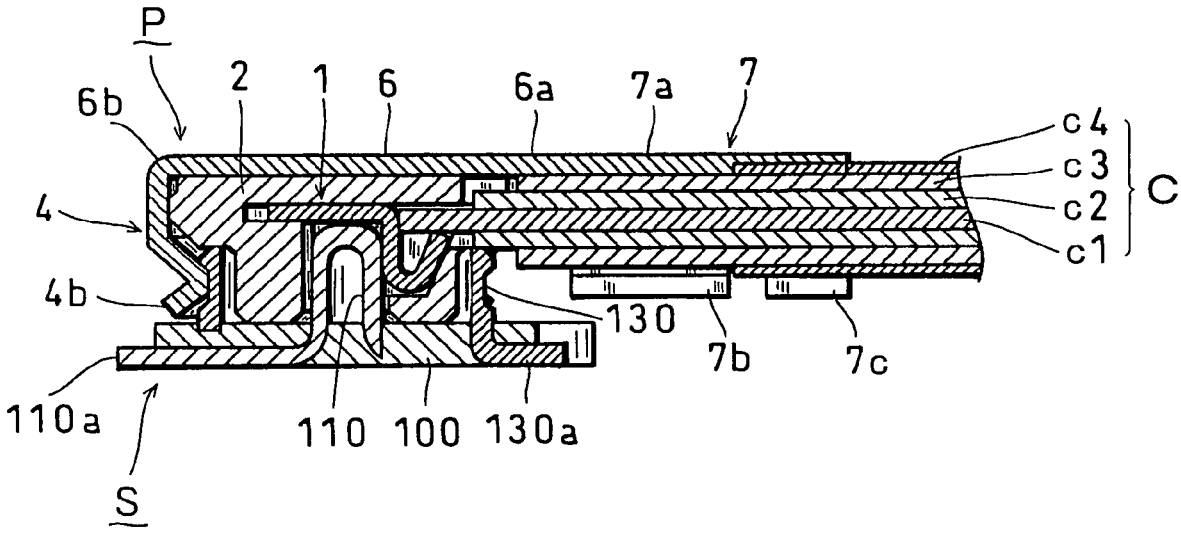
FIG. 4 is a cross sectional side view of the connector at a fitted state.
Figure 5:
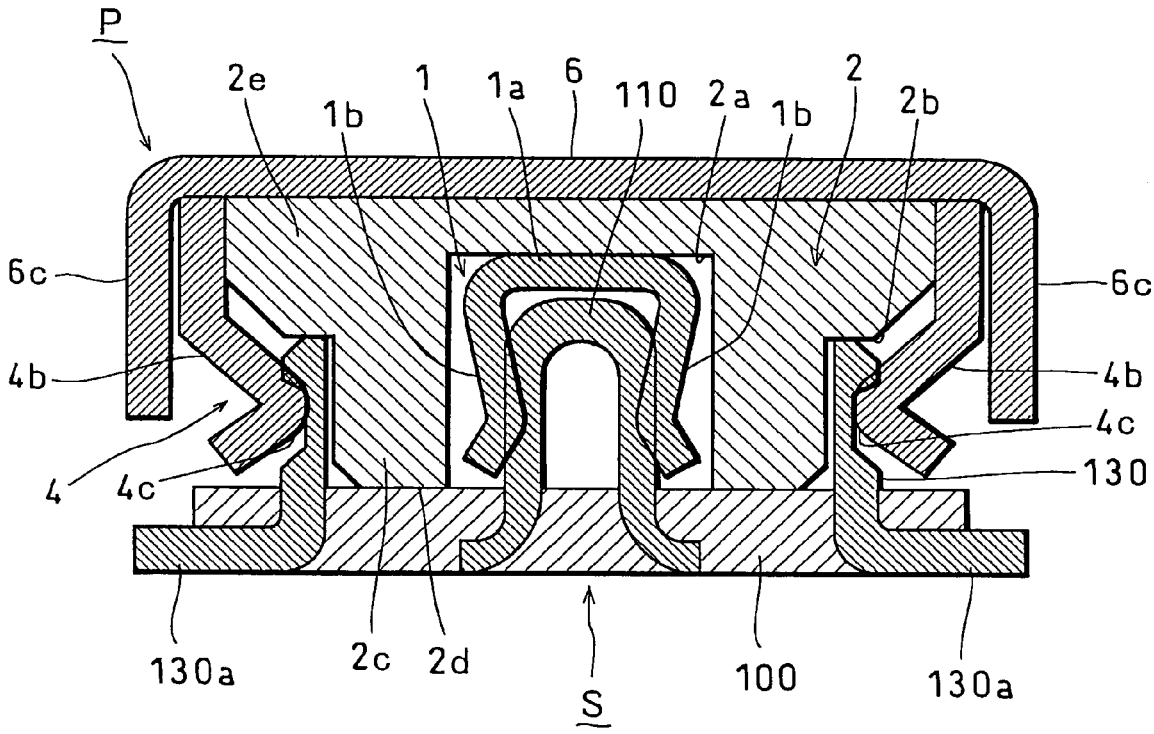
FIG. 5 is a cross sectional front view of the connector at a fitted state.

Then, as illustrated in FIG. 2 and FIG. 3, the receptacle fitting portion 4 of the connector P is fitted to the outside of the outer conductor 130 of the receptacle S with the axis of the receptacle fitting portion 4 of the connector P in alignment with the axis of the outer conductor 130 of the receptacle S and the insertion ports of them opposed to each other. As a result, as illustrated in FIG. 4 and FIG. 5, the outer conductor 130 of the receptacle S is fitted into the annular space 10 of the receptacle fitting portion 4, thereby establishing electrical connection between the outer conductors 3, 130 of the connector P and the receptacle S. At the same time, the small-diameter portion 2*c* of the insulation body 2 in the receptacle fitting portion 4 is fitted into the annular space 120 of the receptacle S, and the contact 110 of the receptacle S is inserted into the center portion of the insulation body 2 in the receptacle fitting portion 4 from the tip end surface 2*d* thereof, thus establishing electrical connection between the contacts 1, 110 of the connector P and the receptacle S. As described above, by fitting the receptacle fitting portion 4 of the connector P into the outside of the outer conductor 130 of the receptacle S, the central conductor c1 and the outer conductor c3 of the coaxial cable C are brought into conduction with the contact 110 and the outer conductor 130 of the receptacle S, respectively, through the contact 1 and the outer conductor shell 3 of the connector P. After the fitting, due to the elasticity of the elastic springs 4*b*, 12A (4*b* and 11) and 12B (4*b* and 11) of the receptacle fitting portion 4 partially constituting the configuration of the double springs 12A, 12B, the contact portions 4*c* on their movable tip end portions are pressed against the outer peripheral surface of the outer conductor 130 of the receptacle S, which retains the fitting and therefore the electrical conduction.

In the event that the connector P is fitted to the receptacle S in an off-center state in which the axis of the receptacle fitting portion 4 of the connector P is slightly deviated from the axis of the outer conductor 130 of the receptacle S, the tip end surface 2*d* of the insulation body 2 of the connector P interferes with the outer conductor 130 of the receptacle S, which prevents the connector P from being further forcedly inserted into the receptacle S, since the tip end surface 2*d* of the insulation body 2 is protruded by a predetermined dimension from the tip end portions of the respective arc-shaped elastic springs 4*b*, 4*b*, 4*b* of the connector P in the direction of insertion to the receptacle S. Therefore, even if the connector P is fitted to the receptacle S in an off-center state, the respective elastic springs 4*b*, 12A (4*b*, 11) and 12B (4*b*, 11) having single and double configurations respectively, which are recessed with respect to the tip end surface 2*e* of the insulation body 2 of the connector P, will not interfere with the outer conductor 130 of the receptacle S, which prevents deformation of the respective elastic springs 4*b*, 12A (4*b*, 11) and 12B (4*b*, 11) having single and double configurations respectively. This prevents degradation in the fitting retaining force between the connector P and the receptacle S due to such deformation resulting in accidental disengagement of the connector P from the receptacle S. Furthermore, since the tip end portion of the contact 110 is protruded by a predetermined dimension from the tip end portion of the outer conductor 130 in the receptacle S in the direction of insertion into the aforementioned connector P, it is possible to ensure that, when the connector P is fitted to the receptacle S, the inserted portion of the contact 110 of the receptacle S inserted between the pair of contact portions 1*b*, 1*b* of the contact 1 of the connector P has a sufficient length, thus preventing poor contact therebetween.

Also, when the connector P is pulled out from the receptacle S by pulling the coaxial cable C, the receptacle fitting portion 4 of the connector P is easily disengaged from the receptacle S in accordance with the principle of leverage, and at this time, as illustrated in FIG. 1, loads are exerted on the respective arc-shaped elastic springs 4*b*, 4*b*, 4*b* of the receptacle fitting portion 4 in the directions of arrows X1, X2 and X3. Furthermore, a greater load is exerted on the arc-shaped elastic spring 4*b* at the side of the receptacle fitting portion 4 opposite to the cable drawing-out direction, namely at the leverage fulcrum side thereof, which induces greater displacement of the two adjacent arc-shaped elastic springs 4*b*, 4*b* at the cable-drawing-side of the receptacle fitting portion 4, namely remote from the fulcrum, wherein the two adjacent elastic springs 4*b*, 4*b* sandwiches the coaxial cable C drawn out outwardly in the radial direction of the receptacle fitting portion 4. Consequently, a largest stress is exerted on the interrupted portions of the receptacle fitting portion 4 having poor constructional strength, illustrated as an A portion and a B portion encircled by two-dot chain lines in FIG. 1, wherein the portion are the extended portions of the right and left cable guides 5, 5 and also the portions of the receptacle fitting portion 4 for drawing out the coaxial cable C. This forces the A and B portions in the directions of the arrows a and b to expand them. However, since the receptacle fitting portion 4 partially has the configurations of the double springs 12A, 12B and furthermore the adjacent arc-shaped elastic springs 4*b*, 4*b* including the A and B portions and sandwiching the coaxial cable C drawn out from the receptacle fitting portion 4 outwardly in the radial direction have the configurations of the double springs 12A, 12B, the elastic forces of the A and B portions are increased and the stress is dispersed therein to reduce the displacement of the A and B portions. Thus, the A and B portions are less prone to deformation. Consequently, it is possible to effectively prevent degradation of the fitting retaining force due to repeated insertion and pull of the connector P into and from the receptacle S and also it is possible to increase the initial retaining force, which improves the reliability of the fitting and contact. This can prevent the receptacle fitting portion 4 from degrading its fitting retaining force resulting in inconvenience of accidental disengagement, etc., due to repeated fitting of a coaxial cable connector, particularly a small-height and small-size L-shaped coaxial cable connector, into the receptacle S.

The outer elastic springs 11, 11 of the double springs 12A, 12B are bent into an arc shape or a tangential straight shape such that their movable tip end portions are more inward than the outer diameter of the receptacle fitting portion 4, before the outer elastic springs 11, 11 are placed outside the receptacle fitting portion 4. Consequently, when the outer elastic springs 11, 11 of the double springs 12A, 12B are placed outside the receptacle fitting portion 4, an initial displacement thereof is generated, which exerts a load to the double springs 12A, 12B themselves. Thus, the receptacle fitting portion 4 has already had an increased elastic force before the coaxial cable C is pulled at the state where the connector is fitted to the receptacle S, and therefore the receptacle fitting portion 4 has greater resistance against deformation in comparison with configurations which constitute double springs 12A, 12B halfway through the displacement. Thus, the receptacle fitting portion 4 exhibits small characteristic changes against repeated insertion and pull, there by effectively alleviating degradation of the fitting retaining force due to repeated insertion and pull of the connector P. Further, the outer elastic springs 11, 11 of the double springs 12A, 12B are formed, by bending, from a portion of the outer conductor shell 3 placed outside the receptacle fitting portion 4 and therefore are integral with the outer conductor shell 3, which can alleviate reduction of the fitting retaining force due to repeated insertion and pull without increasing the number of components and the number of assemble processes.

What is claimed is:

1. A coaxial cable connector, comprising:

a contact which is connected to a central conductor of a coaxial cable;

an insulation body internally equipped with said contact;

a cylindrical receptacle fitting portion including a plurality of arc-shaped elastic springs which are arranged outside said insulation body on a concentric circle and are connected to an outer conductor of the coaxial cable; and elastic springs placed outside said receptacle fitting portion forming thereby a configuration of double springs for said receptacle fitting portion wherein:

said plurality of arc-shaped elastic springs are situated adjacent to each other in said cylindrical receptacle fitting portion, the coaxial cable extends outwardly in the radial direction from said cylindrical receptacle fitting portion; and the outer elastic springs of the double springs have been bent into an arc shape or a tangential straight shape such that their movable tip end portions are more inward than the outer diameter of the receptacle fitting portion, before being placed outside the receptacle fitting portion.

2. The coaxial cable connector according to claim 1, wherein the outer elastic springs of the double springs are formed, by bending, by means of partially using an outer conductor shell placed outside the receptacle filling portion.

3. A coaxial cable connector, comprising:

a contact which is connected to a central conductor of a coaxial cable;

an insulation body internally equipped with said contact;

a cylindrical receptacle filling portion including a plurality of arc-shaped elastic springs which are arranged outside said insulation body on a concentric circle and are connected to an outer conductor of the coaxial cable; and elastic springs placed outside said receptacle filling portion forming thereby a configuration of double springs for said receptacle fitting portion;

a substantially-cylindrical insulation body internally equipped with the contact at its center portion; and an outer conductor shell which is made from a sheet metal and connected to an outer conductor of the coaxial cable, wherein the outer conductor shell includes plural arc-shaped elastic springs placed outside the insulation body on a concentric circle with an annular space interposed therebetween and includes a substantially-cylindrical receptacle fitting portion for housing the insulation body and for drawing out the coaxial cable outwardly in the radial direction, a lid portion which is extended from the opposite side of the receptacle fitting portion from the cable drawing-out portion thereof and is folded onto the bottom surface of the receptacle fitting portion, a crimp flange portion which is extended from the receptacle fitting portion via the lid portion in the cable drawing-out direction and is crimped to the coaxial cable, and a pair of right and left cable guides which are extended directly from the receptacle fitting portion in the cable drawing-out direction and are crimped to the inner side of the crimp flange portion while being in contact with an outer conductor of the coaxial cable, wherein the coaxial cable connector is an L-shaped coaxial cable connector in which the receptacle fitting portion internally equipped with the contact through the insulating body at the center position is crimped and secured to the end portion of the coaxial cable such that the cable drawing-out direction is perpendicular to the direction of insertion into and pulling from a receptacle.

4. The coaxial cable connector according to claim 3, wherein the tip end surface of the insulation body is protruded by a predetermined dimension from the tip ends of the arc-shaped elastic springs of the receptacle fitting portion in the direction of insertion into a receptacle.

5. The coaxial cable connector according to claim 3, wherein the outer conductor shell Includes, at the side with respect to the to-be-bent portion which is provided with the crimp flange portion, confirmation windows for checking the state of the other side of the outer conductor shell.

6. The coaxial cable connector according to claim 5, wherein the outer conductor shell includes protrusions at the side with respect to the to-be-bent portion which is provided with the receptacle fining portion and, when the outer conductor shell is folded into the crimping state, the protrusions are fitted to the confirmation windows.

7. The coaxial cable connector according to claim 3, wherein the receptacle fitting portion of the outer conductor shell houses, at a concentric position, a substantially-cylindrical stepped insulation body internally equipped with the contact at the center portion, the receptacle fitting portion includes slits and is divided into plural portions and there are plural arc-shaped elastic springs separated by the slits, which are elastically displacable in the radial direction and are arranged on a concentric circle outside the insulation body with an annular space interposed therebetween, and the two adjacent arc-shaped springs sandwiching the coaxial cable drawn out outwardly in the radial direction from the receptacle fitting portion constitute the configuration of double springs in cooperation with two elastic springs placed outside thereof.

8. The coaxial cable connector according to claim 7, wherein the outer elastic springs of the double springs are constituted by cantilever flat springs extended in the cable drawing out direction integrally from a pair of positioning walls which are extended from and folded with respect to the right and left side edges of the lid portion and opposed to each other in the direction orthogonal to the cable drawing-out direction across the receptacle fining portion.

9. The coaxial cable connector according to claim 8, wherein the flat springs have been bent into an arc shape or a tangential straight shape such that they gradually get closer to the receptacle filling portion with decreasing distance to their tip ends and their tip ends are brought into contact with the outer peripheral surface of the receptacle fitting portion near the extended portions of the right and left cable guides to constitute the outer elastic springs of the double springs.

10. The coaxial cable connector according to claim 9, wherein the flat springs formed as the outer elastic springs of the double springs by bending are bent into an arc shape or a tangential straight shape such that their movable tip end portions are more inward than the outer diameter of the receptacle fitting portion, before being placed outside the receptacle fitting portion, at a half-developed state in which a to-be-bent portion of the outer conductor shell is straightened so that the lid portion and the crimp flange portion are perpendicular to the bottom surfaces of the receptacle fitting portion and the right and left cable guides and, when the outer conductor shell is folded at the to-be-bent portion into an assembled state in which the lid portion and the crimp flange portion are along the bottom surfaces of the receptacle fitting portion and the right and left cable guides, the outer elastic springs of the double springs are placed outside the receptacle fitting portion causing an initial displacement, which exerts a load to the double springs themselves.

* * * * *

UNITED STATES PATENT AND TRADEMARK OFFICE

CERTIFICATE OF CORRECTION

PATENT NO. : 7,186,142 B2
APPLICATION NO. : 11/108701
DATED : March 6, 2007
INVENTOR(S) : Takayuki Nagata It is certified that error appears in the above-identified patent and that said Letters Patent is hereby corrected as shown below:

In the claims:

in claim 2, column 14, line 67, the word “filling” is incorrect and should be changed to read as: --fitting--;

in claim 3, column 15, in both lines 5 and 10, the word “filling” is incorrect and should be changed to read as: --fitting--;

in claim 5, column 15, in line 49, the word “Includes,” is incorrect and should be changed to read as: --includes,--;

in claim 8, column 16, in line 26, the word “fining” is incorrect and should be changed to read as: --fitting--.

Signed and Sealed this

Twenty-third Day of October, 2007

JON W. DUDAS
*Director of the United States Patent and Trademark Office*